United States Patent [19]

Barrett

[11] 4,443,133

[45] Apr. 17, 1984

[54] METHOD FOR ACHIEVING ACCEPTABLE $U_3O_8$ LEVELS IN A RESTORED FORMATION

[75] Inventor: Richard B. Barrett, Chatham, N.J.

[73] Assignee: Exxon Research and Engineering Co., Florham Park, N.J.

[21] Appl. No.: 325,280

[22] Filed: Nov. 27, 1981

[51] Int. Cl.[3] ..... C09K 17/00; E21B 43/28; E21C 41/08

[52] U.S. Cl. ..... 405/263; 299/5

[58] Field of Search ..... 405/263, 264, 258, 128; 299/4, 5

[56] References Cited

U.S. PATENT DOCUMENTS

| | | | |
|---|---|---|---|
| 3,490,241 | 1/1970 | Kuhn | 405/263 |
| 3,959,975 | 6/1976 | Graf | 405/263 |
| 4,114,693 | 9/1978 | Foster et al. | 299/4 X |
| 4,155,982 | 5/1979 | Hunkin et al. | 299/5 X |
| 4,185,872 | 1/1980 | Habib, Jr. | 299/4 |
| 4,234,231 | 11/1980 | Yan | 299/4 |

*Primary Examiner*—David H. Corbin
*Assistant Examiner*—Nancy J. Stodola
*Attorney, Agent, or Firm*—Joseph J. Dvorak

[57] ABSTRACT

Leached formations having residual soluble uranium minerals therein are restored by treating the formation under alkaline conditions with a source of phosphate ion whereby insoluble uranium phosphate compounds are formed thereby lowering the residual soluble uranium levels below that existing prior to restoration and the formation, and preferably to levels below about 5 milligrams per liter.

9 Claims, 1 Drawing Figure

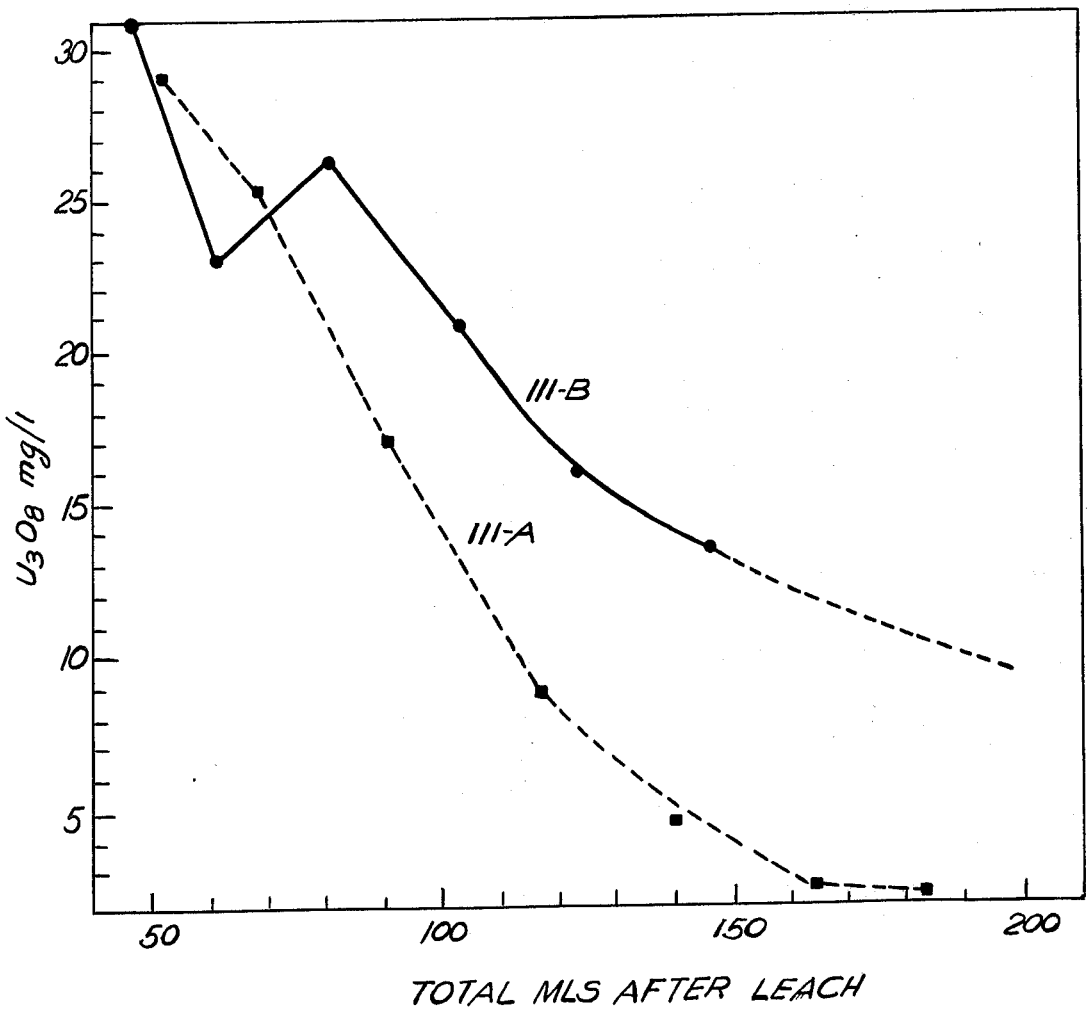
30
25
20
15
10
5
$U_3O_8$ mg/l
III-B
III-A
50
100
150
200
TOTAL MLS AFTER LEACH

METHOD FOR ACHIEVING ACCEPTABLE $U_3O_8$ LEVELS IN A RESTORED FORMATION

FIELD OF THE INVENTION

This invention relates generally to the in situ leaching of uranium and other metal values from underground deposits, and more particularly to achieving acceptable uranium levels in underground formations which have been subjected to in situ leaching operations.

BACKGROUND OF THE INVENTION

The recovery of uranium, vanadium and equivalent elements by in situ leaching operations is described in a number of U.S. patents. In this regard, see, for example, U.S. Pat. No. 2,896,930; U.S. Pat. No. 3,309,140 and U.S. Pat. No. 4,103,963. Typically, in such processes, wells are drilled in accordance with a predetermined selected pattern into an underground deposit of uranium mineral. After completion of the wells, a leach solution is flowed between the wells to dissolve the uranium, vanadium and other metal values in the leach solution. The leach solution is then carried to the surface where the pregnant lixiviant is treated to recover the mineral values therefrom. The leaching process obviously is continued until the concentration of metal values reaches a sufficiently low point where it becomes uneconomical to recover the mineral values from the solution. At this point, soluble uranium remains in the formation at concentration which is environmentally unacceptable.

One approach to reducing the uranium levels in such formations is to continue to remove formation water from the deposit while simultaneously injecting fresh or treated waters. The water removed from the underground deposit can be treated above ground by a technique such as reverse osmosis which in addition to removing a soluble uranium, also removes other contaminants associated with the mining process. Experience has shown that many of the contaminants in such formation waters are quickly reduced to levels which are environmentally acceptable. Solubilization of the uranium, however, in the deposit persists long after other contaminants have been removed. This phenomena apparently is the result of a continued slow diffusion of previously oxidized uranium minerals, or solubilization from minerals which continue to be leached by residual oxidant after the intrusion of fresh water into the formation.

An alternate technique for restoring a formation which has undergone an in situ leaching operation involves the injection into the formation of a restoration fluid which contains reducing agents capable of reducing oxidized mineral and/or metal values to their reduced insoluble state. In this regard, see, for example, U.S. Pat. No. 4,234,231. Since huge excesses of oxidant are used during the mining process, relatively large amounts of reductant will be required during the restoration process, particularly in view of the fact that the reduction process is not selective. Moreover, residual oxygen from the mining process undoubtedly will remain in the resevoir indefinitely, thereby providing a source of oxidant for reoxidation of the reduced uranium. Finally, with increasing environmental regulations and demands, the achievement of even lower levels of solubilized uranium in the restored formation is needed.

SUMMARY OF THE INVENTION

Briefly stated, leached formations having residual soluble uranium minerals therein are restored by treating the formation under alkaline conditions with a source of phosphate ion whereby insoluble uranium phosphate compounds are formed thereby lowering the residual soluble uranium levels below that existing prior to restoration and the formation, and preferably to levels below about 5 milligrams per liter.

The characteristics, features and advantages of the invention will become more readily apparent from the following detailed description when read in light of the accompanying drawing.

BRIEF DESCRIPTION OF THE DRAWING

As indicated, the invention will be described, in part, by reference to the accompanying FIGURE which graphically compares a restoration sequence using fresh water injection with the restoration technique of the present invention.

DETAILED DESCRIPTION

The in situ recovery of uranium and other mineral values from underground deposits of uranium ore essentially involves the drilling of wells into the uranium bearing formation. Typically, the numbers and spacing of the wells are drilled in accordance with a predetermined selected pattern. After the wells are completed, an oxidizing alkaline lixiviant, such as aqueous carbonate and/or bicarbonate solutions, is pumped through the formation from an injection well to a production well. As is known, the uranium present in these formations typically occurs in its reduced tetravalent state and is oxidized to its hexavalent state in order to make the uranium values soluble in the lixiviant. To accomplish this, an oxidant, for example, hydrogen peroxide, air, oxygen or sodium chlorate, is normally injected in the formation along with the lixiviant. The leach solution containing oxidized uranium and other metal values is removed from the production well; and, after the leach solution is brought to the surface, the metal values are recovered from the leach solution.

The continuous leaching of the formation is, of course, subsequently terminated at the point in time when the uranium levels in the leach solution drops below economically recoverable levels.

Unfortunately, experience has shown that after termination of the leaching operation, there is a continued solubilization of uranium into the formation water which persists long after many of the other mineral values have been removed from the formation. This phenomena is a result of the continued slow diffusion from previously oxidized uranium minerals or solubilization from minerals which continue to be leached by residual oxidant after the intrusion of fresh water.

Restoration of the formation in accordance with the practice of the present invention is achieved by injecting a phosphate ion source into the formation which is capable of reacting with the hexavalent uranium present in the formation so as to form water insoluble uranium phosphates. More specifically, the phosphate ion source material is introduced into the formation under weakly acidic to basic conditions, and preferably under alkaline carbonate conditions. Thus, the pH during the restoration of the formation should be in the range generally from about 5 to 12, and preferably in the range of 6.5 to 8.

Among the phosphate sources that may be used in the practice of the present invention are phosphoric acid, and alkali metal and alkaline earth metal phosphates and mixtures thereof. Among alkali metal phosphates, special mention is made of sodium phosphate, sodium acid phosphate, sodium dihydrogen phosphate, sodium polyphosphate and the potassium analogues thereof. Additionally, any material which is capable of producing phosphate or acid phosphate moieties under the restoration conditions may also be employed in the practice of the present invention.

In a particular restoration operation, the amount of phosphate source to be employed can easily be determined based on the uranium levels of the formation water at the time of termination of the leaching operation. Typically, the amount of phosphate source employed will be in excess of that required to precipitate the uranium soluble in the formation water, and, indeed, it will be from about 100 to about 500 grams per metric ton of rock contained in the formation being restored. Since the phosphate source is environmentally acceptable, the phosphate source injected into the formation need not be removed, but may be shut in. Optionally, however, after the phosphate source is shut in the formation for a reasonable but extended period of time, for example, for about 30 to 180 days, fresh water may be injected into the formation until the water in the formation reaches desired contaminant levels.

The solubility of uranium phosphates in carbonate and bicarbonate solutions are set forth herein to further illustrate the present invention. In these experiments, three solutions were prepared by adding 100 milligrams of the uranium compound set forth in Table I to a 200 milliliter solution containing 70 milligrams $CaSO_4.2H_2O$. The pH of the resultant solution was adjusted with sodium hydroxide or sulfuric acid to a value given in Table I. The solution was agitated intermittently over a one week period. The concentration of uranium and carbonate were subsequently determined. As can be seen in Table I, under slightly alkaline conditions hexavalent uranium phosphate compounds are substantially insoluble in water.

TABLE I

Solubility of Uranium Phosphates in Carbonate Solution

| Compound | $CO_3$ mg/l | pH | U (mg/l) |
|---|---|---|---|
| $Ca(UO_2)_2(PO_4)_2.4H_2O$ | 1200 | 7.5 | 0.5 |
| | 1200 | 9.0 | 0.8 |
| | 220 | 7.5 | <0.5 |
| | 220 | 9.0 | 0.9 |
| $Na_2(UO_2)_2(PO_4)_2.4H_2O$ | 1200 | 7.5 | <0.5 |
| | 1200 | 9.0 | <0.5 |
| | 220 | 7.5 | <0.5 |
| | 220 | 9.0 | <0.5 |
| $UO_2(UO_2)_2(PO_4)_2.4H_2O$ | 1200 | 7.5 | <0.5 |
| | 1200 | 9.0 | <0.5 |
| | 220 | 7.5 | <0.5 |
| | 220 | 9.0 | <0.5 |

To further illustrate the present invention, uranium phosphate was precipitated from a 1 liter solution containing $UO_4.4H_2O$ and $NaHCO_3$ in an amount sufficient to bring the carbonate up to the level set forth in Table II. Thereafter, the pH of the solution was adjusted with sulfuric acid or sodium hydroxide as required. Finally, the $Na_3PO_4.12H_2O$ was added as a concentrated solution to attain the desired levels.

The foregoing solutions were thereafter sampled after standing for 1 to 2 weeks at room temperature. As can be seen from Table II, the uranium present in the solution was lowered significantly as a result of the precipitation of the dissolved uranium originally in the solution in the form of phosphate salts.

TABLE II

Precipitation of Uranium Phosphate from Carbonate Solutions

| Trial | $CO_3$ (mg/l) | pH | Initial U (mg/l) | Final U (mg/l) |
|---|---|---|---|---|
| 1 | 1200 | 7 | 30 | 3 |
| 2 | 1200 | 8.5 | 120 | 6 |
| 3 | 1200 | 7.0 | 120 | 3 |
| 4 | 200 | 7.0 | 5 | 0.2 |
| 5 | 200 | 7.0 | 5 | 0.2 |

To illustrate the precipitation of uranium salts from solutions more akin to uranium solutions obtained typically at the termination of leaching processes, the tests outlined in Table III were conducted. In these experiments, each solution contained 5 milliliters of 0.2 molar $UO_2SO_4.2H_2O$ and an appropriate amount of $1\times10^{-2}$ molar phosphoric acid or sodium phosphate to achieve the desired $PO_4/U$ ratio in 100 milliliters of gypsum saturated sodium carbonate solution. Total carbonate was 220 milligrams per liter. The samples stood for four days at room temperature before analysis. The results are given in Table III.

TABLE III

Precipitation from "Terminal" Restoration Solutions

| Trial | Phosphate | $PO_4/U$ | Final U (Mg/l) | Final pH |
|---|---|---|---|---|
| 1 | $H_3PO_4$ | 5 | 0.8 | 7.96 |
| 2 | $H_3PO_4$ | 1 | 0.6 | 8.16 |
| 3 | $Na_3PO_4.12H_2O$ | 1 | 1 6 | 8.22 |
| 4 | $H_3PO_4$ and $Na_3PO_4.12H_2O$ | 3 | 1 | 8.30 |

Finally, the present invention is compared in the accompanying FIGURE with a restoration sequence using fresh water injection. The experimental details are given below.

A 2.54 cm i.d. glass column was packed with 100 grams of dried, disaggregated uranium ore which had been crushed to minus 20 mesh. This material was wetted with 29 milliliters of a synthetic ground water approximating the composition of waters found in uranium bearing aquifers. This was followed by leaching with an aqueous lixiviant containing 1.2 g/l total carbonate and 0.5 g/l $H_2O_2$. Thereafter, 29 milliliters of the synthetic ground water was delivered to the column.

Next, twenty milliliters of 150 mg/liter phosphate (50 mg/l phosphorus) as a $Na_3PO_4.12H_2O$ solution was introduced and the column shut in for 24 hours and the amount of soluble uranium was determined. This procedure was repeated until a total dosage of 23 milligrams of phosphate (7.5 milligrams of phosphorus) had been delivered to the ore.

As can be seen in the FIGURE, the uranium content of solutions produced from Column III-A, which received the phosphate treatment, decreases more rapidly than that from Column III-B, which was treated in an identical manner except that phosphate-free water was passed through the column.

From the above, it can be seen that by injecting a leached formation with a source of phosphate ions under alkaline conditions, the residual soluble uranium present in the formation can be rendered insoluble, thereby rendering the formation to environmentally acceptable conditions.

What is claimed is:

1. A method of restoring a formation which had uranium and other mineral values therein extracted by an aqueous alkaline lixiviant, whereby an aqueous solution remains in said formation said restoration method comprising adjusting the pH of the aqueous solution in said formation to a range of from about 5 to about 12 and introducing into said formation a source of phosphate in an amount sufficient to lower the level of soluble uranium compounds below that previously existing in the formation by the formation of insoluble hexavalent uranium phosphate compounds.

2. The method of claim 1 wherein said source of phosphate ion is present in an amount sufficient to lower the level of soluble uranium in said formation water to levels below about 5 milligrams per liter.

3. The method of claim 2 wherein the amount of phosphate source introduced into the formation ranges from about 100 to about 500 grams per ton of rock contained in the formation being restored.

4. The method of claim 3 wherein the pH is in the range of from about 6.5 to 8.

5. The method of claim 4 wherein said phosphate source is selected from the group consisting of phosphoric acid, alkali metal phosphates, alkaline earth metal phosphates, compounds capable of producing phosphate and acid phosphate moieties under restoration conditions, and mixtures thereof.

6. The method of claim 5 wherein said alkali metal phosphates include sodium phosphate, sodium acid phosphate, sodium dihydrogen phosphate, sodium polyphosphate and the potassium analogues thereof.

7. The method of claim 6 wherein said source of phosphate ion is retained in said formation for a period of from about 30 to about 180 days.

8. A method of restoring a formation which had uranium and other metal values extracted therefrom by an aqueous alkaline lixiviant, said restoration method comprising introducing into said formation a source of phosphate ions in an amount ranging from about 100 grams to about 500 grams per ton of rock in said formation in the presence of carbonate and under conditions to provide a pH in the formation ranging from about 5 to about 12, and retaining said phosphate ion source in said formation for an extended period of time whereby insoluble hexavalent uranium compounds of phosphate are formed.

9. The method of claim 8 wherein said pH is in the range of from about 6.5 to 8 and wherein said phosphate source is selected from the group consisting of phosphoric acid, alkali metal phosphates, alkaline earth metal phosphates, compounds capable of producing phosphate and acid phosphate moieties under restoration conditions, and mixtures thereof.

* * * * *